United States Patent [19]

Ewert

[11] Patent Number: 4,944,213

[45] Date of Patent: Jul. 31, 1990

[54] COMPENSATOR FOR HAND-HELD FIREARMS

[75] Inventor: Charles Ewert, Luxembourg, Luxembourg

[73] Assignee: Unipatent Holding S.A.

[21] Appl. No.: 259,159

[22] Filed: Oct. 18, 1988

[30] Foreign Application Priority Data

Oct. 19, 1987 [AT] Austria ..... 2762/87

[51] Int. Cl.[5] ..... F41A 21/36

[52] U.S. Cl. ..... 89/14.3

[58] Field of Search ..... 42/1.06, 97; 89/14.3, 89/14.1, 14.2, 14.4, 14.5, 14.6

[56] References Cited

U.S. PATENT DOCUMENTS 2,139,691 12/1938 Michal, Jr. ..... 89/14.3
3,051,057 8/1962 Ivy ..... 89/14.3
4,006,548 2/1977 Vignini ..... 42/97
4,058,050 11/1977 Brouthers ..... 89/14.3
4,479,418 10/1984 Beretta ..... 89/14.4

*Primary Examiner*—Charles T. Jordan
*Assistant Examiner*—Michael J. Carone
*Attorney, Agent, or Firm*—Toren, McGeady & Associates

[57] ABSTRACT

The invention is directed to a compensator 4, 4' for a hand-held firearm 1. Herein it is provided that the compensator is connected solidly with the grip or stock 2; however, that it is possibly connected so as to be removable.

In one embodiment, the compensator 4, 4' is arranged detachably on an extension of the grip 2', which on its part is fastened to the grip 2 preferably detachably.

The invention enables an ideal force introduction from the compensator 4, 4' into the grip 2, causes no complications when disassembling the weapon and allows the utilization of compensators respectively adapted to the ammunition.

11 Claims, 2 Drawing Sheets

COMPENSATOR FOR HAND-HELD FIREARMS

Figure 1:
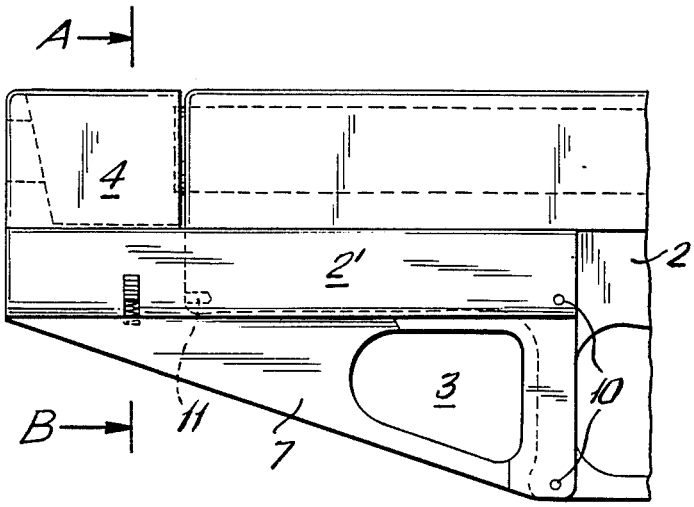

The invention is directed to a compensator for hand-held firearms.

Such compensators, which are meant to prevent or at least weaken the upward kick and recoil of hand-held firearms are already known.

Thus, it is known in hand-held firearms with the fixed barrel to attach the compensator at the barrel. In hand-held firearms with a drop barrel, such an arrangement is not expedient, since the forces transmitted by the compensator impair the desired orderly motions of the barrel and the breech and since not only a change in the firing characteristic of the weapon occurs, rather there arise also stoppages, ejection malfunctions and other functional flaws.

In case of compensators which are connected with a breech, the entire barrel must be able to pass through said breech, since otherwise an opening of the breech would not be possible. Such compensators have not only a low efficiency because of the larger apertures permitting the passage of the barrel, rather they are also disadvantageous for the motion and thus the orderly functioning of the breech. By compensator, we mean here every device which is able to redirect the propellant gases leaving the barrel muzzle, permitting as mentioned above a reduction or prevention of the upward kick and the recoil of the hand-held weapon. Such compensators are also called muzzle brakes in weapons technology.

The invention pursues the aim of creating a compensator which does not impair the motions and thus the functioning of the barrel and/or the breech, which does not render the disassembly and cleaning of the weapon considerably more complicated and fraught with effort than would be the case without a compensator and which introduces the forces acting upon it into the weapon in the best possible manner.

Therefore, it is provided in the invention that the compensator is connected rigidly but possibly in a removable manner with the grip or stock. This measure permits to design the barrel and the breech completely independently of the compensator and also assures that the movements of these parts with respect to each other and with respect to the grip or stock are not impaired. This measure also eliminates the mechanical stressing of the barrel or the breech, particularly in bending, by the redirected propellant gases.

It is provided in one embodiment that the compensator can be attached at the hand-held firearm by means of a guide arranged in the grip and which is at least approximately parallel to the barrel and that it can be fixed or locked in position by means of a latching element. This embodiment has the advantage that during disassembly of the hand-held firearm, for instance when cleaning same, a removal of the compensator can occur rapidly and without problems and that, by this measure, the disassembly of the hand-held firearm does not become more effort-consuming or complicated than in the case of a comparable hand-held firearm without compensator. This measure affords additionally the advantage that when using different types of ammunition, appropriate compensators can in each case be attached easily and rapidly.

It goes without saying that compensators can comprise all known and usual characteristics. Thus especially multi-chamber compensators can be used and compensators can also be used whose outlet apertures are in slotted shape or which have other particularities.

An embodiment where light materials such as plastic or aluminum are used affords the advantage that the center of gravity of the weapon is hardly affected and that the total weight of the weapon can be kept low. In the version using plastics material, metallic inserts in the compensator and the stock can be provided.

Figure 3:
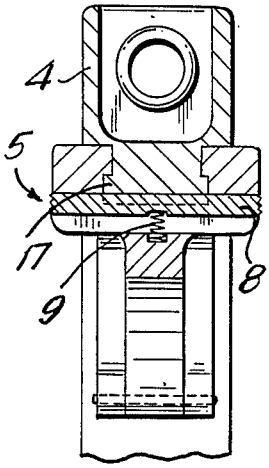
Figure 2:
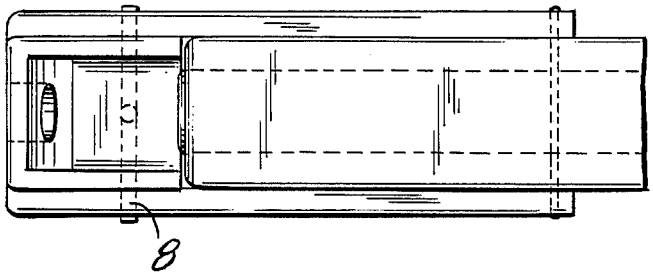

The invention is described with particularity with the help of the attached drawing. It is shown in: FIGS. 1–3 an embodiment form for a hand-held firearm with the compensator per the invention attached in side and front view as well as in section; and FIGS. 4–7 another embodiment form with a compensator attached in respectively the same views as FIGS. 1–3.

The hand-held firearm 1 comprises a grip or stock 2. An extension part 2' constitutes a lengthening of the grip, in which a guide 17, for instance a dovetail guide, is provided ahead of the front end of the barrel, which dovetail co-acts with a complementary guide of a compensator 4. A finger passage 3 for firing with both hands is provided in the extension 2' in this embodiment example.

The connection of the extension piece 2' with the grip 2 occurs by means of connecting pins 10 and one or several centering pins 11. Naturally, any other type of connection, for instance a bolted connection, can be provided.

In the embodiment example the compensator is slid from the front in direction of the barrel onto the guide 17 of the part 2' and is maintained in its position by a platelet-shaped latching element 8 displaceable perpendicularly to the direction of the barrel and to the direction of the guide, which element cooperates with a recess in the compensator. The latching element can be brought out of the path of motion of the compensator 4 by means of a handling member 5 against the action of a spring 9, whereby said compensator is released and can be removed from the extension of the grip or stock 2'.

Figure 4:
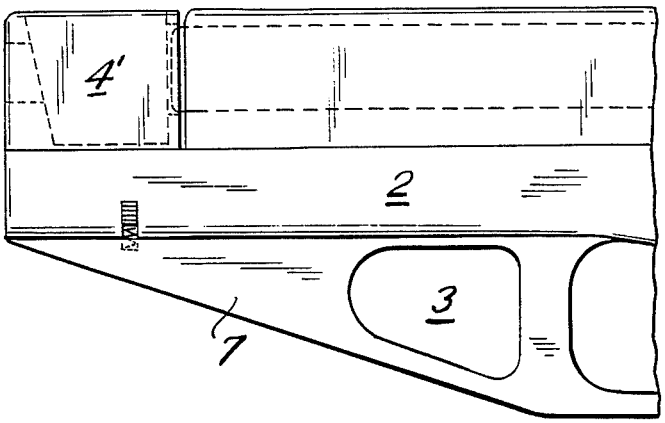
Figure 5:
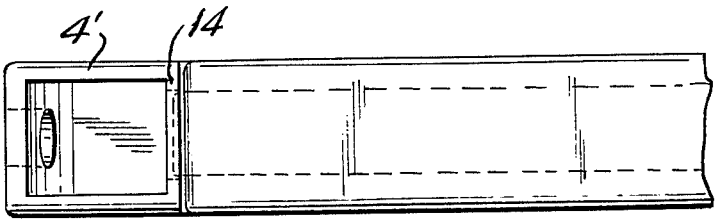

The compensator can be open in direction of the firearm, meaning that it can be U-shaped in elevation as is discernible in FIGS. 1 and 2. It is, however, naturally possible to design the compensator "in a closed manner", meaning with a wall on the side of the weapon wherein only an aperture for the barrel is provided in the wall. This second embodiment has the advantage of preventing an action of the exiting gases upon the front side of the breech. Such an embodiment is shown in FIGS. 4 and 5.

The construction of the compensator itself is left to the specialist and basically does not differ from the construction of conventional compensators which are fastened at the barrel or the breech.

A design of the part 2' favorable for the stability provides the placing of a stiffener or a support 7 between the aperture 3 and the grip 2, since this causes a favorable flow of forces between the two parts.

Figure 6:
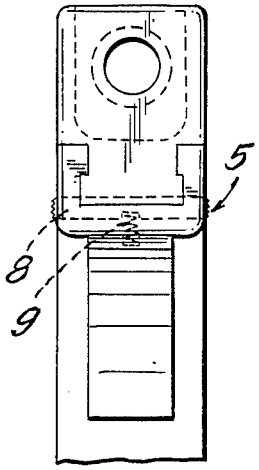

A version is depicted in FIGS. 4–7, where the grip 2 itself is lengthened and where the extension part designated by 2' is integral with the grip. Since in this version no overlap of the part 2' over the grip 2 and no fixing pins are necessary, it is possible to conceive the weapon to be lighter and more slender, as a comparison between FIGS. 3 and 6 shows.

The compensator 4' of the second embodiment form according to FIGS. 4–7 comprises a wall 14 on the side of the weapon, which covers the front side of the breech and comprises only one opening for the barrel.

Figure 7:
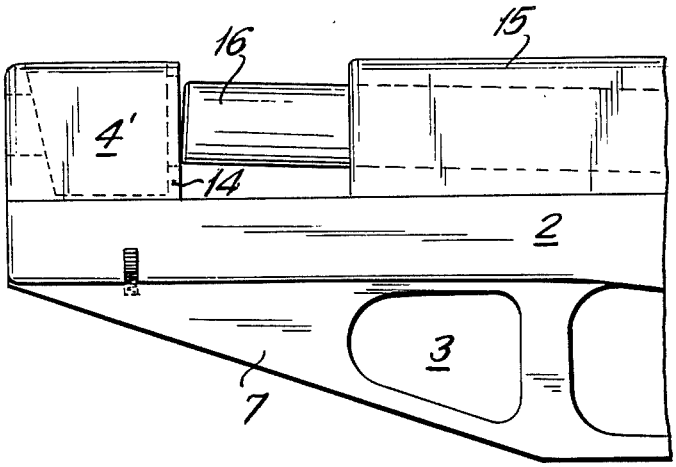

FIG. 7 illustrates that the slide bolt 15, upon firing a shot, is located in the rear position and the barrel 16 is tilted to allow introduction of a next round.

The invention is not limited to the illustrated embodiment example; rather, it can be varied and modified in many ways. Thus, it is possible to provide instead of a dovetail guide 17 at the topside of the grip extension, side guides, inner guides or also other guides or folding—or pivoting—mechanisms. It is equally possible to connect the compensator solidly with the grip, if this does not cause problems when disassembling the weapon. The separation between the compensator 4 proper and the grip or its extension 2, 2' can be located at another point than that shown in the embodiment example. Also, the locking between the grip and the compensator can be accomplished in other ways than shown.

It is essential for the invention that the compensator is solidly connected with the grip in the operationally ready state and in this way assures a favorable and direct flow of forces between the compensator and the grip without affecting the barrel and the breech.

If the extended part of the grip consists of plastics material, it is advantageous to design the guide for the compensator of metal and to cast same into the plastics material.

The invention also permits to simply and effectively modify already existing weapons without a compensator, since only the attachment of a fastening device for a grip extension is required, which is also easily possible, for instance by means of fastening pins.

I claim:

1. A compensator arrangement for redirecting propellant gases leaving the barrel muzzle of a hand-held firearm having a grip and a barrel, comprising:

a compensator attached to the grip so as not to interfere with disassembly and servicing of the firearm, and so as to be in front of the barrel;

an extended grip portion provided so as to extend under and toward the front of the barrel, the compensator being attached to the extended grip portion; and latch means for locking the compensator on the extended grip portion.

2. A compensator arrangement as defined in claim 1, wherein the compensator is removably attached to the extended grip portion.

3. A compensator arrangement as defined in claim 1, and further comprising guide means for sliding and attaching the compensator on the extended grip portion.

4. A compensator arrangement as defined in claim 1, wherein the extended grip portion is formed by a separate grip extension piece.

5. A compensator arrangement as defined in claim 4, wherein the compensator is fastened at the grip extension piece.

6. A compensator arrangement as defined in claim 1, and further comprising a spring arranged so as to bias the latching means into a retraining position, the latching means being displaceable transversely to a guidance direction of the compensator.

7. A compensator arrangement as defined in claim 1, wherein the latch means includes one of a pin or a platelet.

8. A compensator arrangement as defined in claim 1, wherein the extended grip portion has an aperture arranged so as to facilitate two-handed firing of the firearm.

9. A compensator arrangement as defined in claim 8, and further comprising a support arranged so as to extend between the extended grip portion and the aperture so as to facilitate forceflow therebetween.

10. A compensator arrangement as defined in claim 1, wherein the firearm has a drop barrel.

11. A compensator arrangement as defined in claim 1, wherein the compensator is made of a plastic material.

* * * * *